US005164252A

United States Patent [19]

Henning et al.

[11] Patent Number: 5,164,252

[45] Date of Patent: Nov. 17, 1992

[54] HYDROPHOBIZING AND OLEOPHOBIZING COMPOSITIONS

[75] Inventors: Wolfgang Henning, Kürten; Walter Meckel, Neuss; Thomas Münzmay, Dormagen; Wilfried Kortmann, deceased, late of Nachrodt-Wiblingverde, by Margot Kortmann, Bettina Kortmann, Axel Kortmann, heirs; Peter Selinger; Peter Nussbaum, both of Leverkusen, all of Fed. Rep. of Germany

[73] Assignee: Bayer Aktiengesellschaft, Leverkusen, Fed. Rep. of Germany

[21] Appl. No.: 616,554

[22] Filed: Nov. 21, 1990

[30] Foreign Application Priority Data

Nov. 29, 1989 [DE] Fed. Rep. of Germany ..... 3939341

[51] Int. Cl.[5] ..... B32B 7/00; C08F 2/20; C08F 283/00

[52] U.S. Cl. ..... 428/245; 524/457; 525/455; 427/393.4; 252/8.6; 252/8.8; 252/8.9; 428/290

[58] Field of Search ..... 524/457, 591; 427/393.4

[56] References Cited

U.S. PATENT DOCUMENTS 4,616,061 10/1986 Henning et al. ..... 524/591
4,636,545 1/1987 König et al. ..... 524/457

*Primary Examiner*—George F. Lesmes
*Assistant Examiner*—Chris Raimund
*Attorney, Agent, or Firm*—Sprung Horn Kramer & Woods

[57] ABSTRACT

Phobicity effects of high quality and permanence are obtained on textile materials of the most diverse types if these are finished with combinations of
A) a polymer containing perfluoroalkyl groups and
B) a cationically modified polyurethane.

The new compositions are also distinguished by a comparatively low content of expensive fluorine compounds.

10 Claims, No Drawings

HYDROPHOBIZING AND OLEOPHOBIZING COMPOSITIONS

The present invention relates to hydrophobizing and olephobizing compositions based on polymers containing perfluoroalkyl groups.

Such fluorine compounds are rarely used alone in practice in finish formulations. Urea resins, melamine resins or other resins usually based on methylol compounds are thus employed for better fixing of the fluorine products and also to improve the dimensional stability of the textile substrates. Fluorine compounds are combined with extenders, for example with paraffin fractions or paraffin waxes and/or fatty acid esters and melamine resins, to assist the phobicity values, usually the hydrophobicity values (compare Chwala/Anger: "Handbuch der Textilhilfsmittel (Handbook of Textile Auxiliaries)", Verlag Chemie-Weinheim-New York 1977, pages 745 to 747, 721).

Such formulations sometimes achieve adequate to good phobicity effects on various substrates even with reduced contents of fluorine components, but the permanence of these finishing effects towards multiple washes at 40° or 60° C. in household washing machines using customary household detergents is inadequate.

However, it is desirable to achieve an increased phobicity action by addition of extenders and not by increasing the fluorine component. At the same time, with a significant reduction in the expensive fluorine component, the extender should compensate the reduction in phobicity values which usually occurs. In both cases, however, there should be adequate permanence to washing.

According to the general prior art, however, this aim can only be achieved if the fluorine compound in the phobizing formulation .is significantly increased and correspondingly high amounts of the synthetic resin component are added for better fixing.

Surprisingly, it has now been found that phobizing effects of high quality and permanence are obtained on the most diverse textile substrates without the disadvantage mentioned if a cationically modified polyurethane is employed as the extender.

The invention thus relates to hydrophobizing and oleophobizing compositions containing (A) a polymer container perfluoroalkyl groups and (B) a cationically modified polyurethane.

Suitable components (A) are commercially available perfluoroalkyl polymers from the series comprising vinyl, styryl, vinylidene, acrylic, methacrylic and α-chloroacrylic polymers which contain perfluoroalkyl groups and have 4 to 20 C atoms in the perfluoroalkyl radical. Examples of these products are polymers and copolymers of the following compounds:

$C_5F_{11}CH_2O_2CC(CH_3)=CH_2$
$C_7F_{15}CH_2O_2CC(CH_3)=CH_2$
$C_9F_{19}CH_2O_2CCH=CH_2$
$C_8F_{17}SO_2N(C_2H_5)C_2H_4O_2CC(CH_3)=CH_2$
$C_8F_{17}SO_2N(CH_3)C_2H_4O_2CCH=CH_2$
$C_8F_{17}CON(C_2H_5)C_2H_4O_2CC(CH_3)=CH_2$
$C_8F_{17}C_2H_4O_2CC(CH_3)=CH_2$
$C_8F_{17}SO_2N(CH_3)COC(CH_3)=CH_2$
$C_8F_{17}C_2H_4O_2CCH=CHCO_2C_2H_4C_8H_{17}$
$C_8F_{17}SO_2N(C_3H_7)C_2H_4OCOCH=CH_2$
$C_8F_{17}SO_2N(CH_3)C_{11}H_{22}OCOCH=CH_2$ $C_8F_{17}SO_2N(CH_3)C_{10}H_{20}OCOCH=CH_2$
$C_8F_{17}SO_2N(CH_3)C_{11}H_{22}OCOC(CH_3)=CH_2$
$C_5F_{11}CH_2OCOC(CH_3)=CH_2$
$C_7F_{15}CH_2OCOC(CH_3)=CH_2$
$C_8F_{17}SO_2N(C_2H_5)C_2H_4COOCH=CH_2$
$C_7F_{15}C_3H_6COOCH=CH_2$
$C_4F_9COOCH_2CH=CH_2$
$C_8F_{17}SO_2N(C_2H_5)COCH=CH_2$
$C_7F_{15}CH_2O_2CCH=CHCO_2CH_2C_7F_{15}$
$C_3F_7CH_2O_2OCF=CH_2$
$C_3F_7CH_2O_2CCF=CF_2$
$(C_3F_7)_3CCH_2O_2CCH=CH_2$
$C_8F_{17}(CH_2)_3O_2CCH=CH_2$
$C_6F_{17}COCH_2CH_2CH_2O_2CCH=CH_2$
$C_8F_{17}(CH_2)_{11}O_2CC(CH_3)=CH_2$
$C_8F_{17}SO_2CH_2CH_2O_2CCH=CH_2$
$C_8F_{17}SOCH_2CH_2O_2CCH=CH_2$
$C_8F_{17}CON(C_2H_5)(CH_2)_2O_2CC(CH_3)=CH_2$
$C_{12}F_{25}SO_2NH(CH_2)_1O_2CC(CH_3)=CH_2$
$C_{12}F_{25}SO_2C_6H_4CH=CH_2$

N-butylperfluorooctanesulfonamiodoethyl acrylate,
N-ethylperfluorooctanesulfonamidoethyl methacrylate,
N-methylperfluorobutanesulfonamidobutyl acrylate,
N-ethylperfluorooctanesulfonamidoethyl-α-chloroacrylate,
1,1-dihydroperfluorohexyl acrylate,
1,1-dihydroperfluorodecyl methacrylate
1,1-dihydroperfluorooctyl ω-chloroacrylate
3-(perfluorooctyl)-propyl acrylate,
2-(perfluoroheptyl)-ethyl methacrylate,
11-(perfluorooctyl)-undecyl acrylate and
3-(perfluoroheptyl)-propyl chloroacrylate.

Preferred compounds are acrylate (Co)polymers having a fluorine content of 20 to 45, in particular 35 to 45% by weight.

Compounds of this type are described, for example, in DE-A-1,595,017, 1,595,018, 2,134,978 and 2,939,549.

Such compounds have preferably been employed in the form of their aqueous emulsions or dispersions.

Suitable polyurethane components B) are known and are described, for example, in the following patent specifications: DE-A-880,485, DE-A-1,044,404, U.S. Pat. No. 3,036,998, DE-A-1,178,586, DE-A-1,184,946, DE-A-1,237,306, DE-A-1,495,745, DE-A-1,595,602, DE-A-1,770,068, DE-A-2,019,324, DE-A-2,035,732, DE-A-2,446,440, DE-A-2,345,256, DE-A-2,345,245, DE-A-2,427,274 and U.S. Pat. No. 3,479,310.

Reaction products of (a) organic polyisocyanates with (b) compounds containing groups which are reactive towards isocyanate groups are preferred, at least a proportion of compounds used as build-up component (a) and/or (b) being compounds which contain a saturated or unsaturated aliphatic hydrocarbon radical having up to 35 carbon atoms, preferably having 9 to 22 carbon atoms, or an aromatic hydrocarbon radical having 6 to 10 carbon atoms, or an araliphatic hydrocarbon radical having 7 to 10 carbon atoms, it being possible, if several radicals exist in the same molecule, for different radicals corresponding to the definition given to be present at the same time.

Examples of such build-up components are described, for example, in DE-A TM 2,400,490 in the form of aliphatic dihydroxy compounds having aliphatic substituents which contain at least 10 carbon atoms.

Preferably, at least a proportion of the compounds used as build-up component (a) and/or (b) are compounds containing acylurea groups of the formula $$-NH-CO-\underset{|}{N}-CO-R$$

the amount of which is chosen so that the polyisocyanate addition product contains 0.1 to 20% by weight, based on the solids content, of the structural unit of the formula $$-NH-CO-\underset{|}{N}-CO-$$

forms the acylurea groups mentioned and wherein R denotes a saturated or unsaturated aliphatic hydrocarbon radical having up to 35 carbon atoms, preferably having 9 to 22 carbon atoms, or an aromatic hydrocarbon radical having 6 to 10 carbon atoms or an aliphatic hydrocarbon radical having 7 to 10 carbon atoms, or wherein, if several radicals R exist in the same molecule, different radicals corresponding to the definition given can be present at the same time.

The cationically modified polyurethanes are especially preferably employed in the form of their aqueous solutions or dispersions and contain a content of guarantees their solubility or dispersibility in water, and if appropriate incorporated ethylene oxide units present within a polyether chain, the content of ternary or quaternary ammonium compounds being 2 to 300 milliequivalents per 100 g of solid and the content of the ethylene oxide units mentioned being 0 to 25% by weight, based on the solid.

Such solutions or dispersions are already known per se and are described in DE-A-3,523,856.

The compositions according to the invention are used in particular as textile finish compositions for phobizing textiles. They are in the form of aqueous dispersions having a solids content of 10 to 50%, preferably 15 to 40%. At a solids content of 15%, the mixing ratio of perfluorine compound (A) to cationically modified polyurethanes (B) in the finish liquor is, for example, 0.5:1 to 10:1, in particular 1:1 to 5:1, based on the solids content.

The aqueous dispersions according to the invention can contain other constituents, such as other textile auxiliaries, for example synthetic resins.

These other constituents are preferably nonionic or cationic in nature.

Before use on the textile materials, the aqueous dispersions are diluted with water. The application rates are chosen so that they achieve an add-on level of 0.5 to 15 g, preferably 0.5 to 5 g and in particular 0.5 to 1.5 g of solid of the substance according to the invention per kg of textile material.

Surprisingly, it is found that outstanding hydrophobizing and oleophobizing effects can already be achieved with these relatively low add-on levels.

Naturally occurring and synthetic materials, such as fibers, filaments, yarns, nonwovens and woven and knitted fabrics, of, in particular, cellulose and its derivatives, and also of polyester, polyamide and polyacrylonitrile materials, wool or silk can be finished successfully using the mixtures according to the invention.

The hydrophobized or oleophobized textile structures, for example nonwovens or in particular woven fabrics, are used, for example, for the production of umbrella coverings, tents, water-repellant clothing or covers, balloon covers, awnings, textile floor coverings, packaging materials or footwear.

The finishing is carried out by known processes, preferably by the exhaust or pad-mangling process, for example between room temperature and 40° C., but also by slop-padding or spraying with a subsequent heat treatment at 80 to 180, preferably 120° to 150° C.

The parts and percentages stated in the following examples relate to the weight, unless noted otherwise.

The products listed below were used in the examples:

Cationically modified polyurethane (B)

Component 1: approximately 15% strength aqueous cationically modified polyurethane dispersion according to DE-A-3,523,856 (Example 1), that is to say a product prepared in the following manner:

A mixture of toluylene 2,4-diisocyanate and toluylene 2,6-diisocyanate are carbodiimidized with a solution of a mixture of 1-methyl-1-phospha-2-cyclopentene 1-oxide and 1-methyl-1-phospha-3-cyclopentene 1-oxide in N-methylpyrrolidone. The reaction is interrupted with phosphorus trichloride at an NCO value of 20.6%. Butane-1,4-diol and acetone are then added. After 30 minutes, the NCO value has fallen to 0%. Stearic acid is then added and the mixture is reacted for 40 minutes down to an acid number of 0. Thereafter, further portions of a mixture of toluylene 2,4-diisocyanate and toluylene 2,6-diisocyanate are added and the mixture is reacted to an NCO value of 8.0%. It is diluted with acetone, and N-methyldiethanolamine and n-butanol are added. At an NCO value of 0%, the mixture is salted with DL lactic acid and the product is then dispersed with water.

Phobizing composition (A) containing perfluoroalkyl groups

Component II: an acrylate copolymer which contains perfluoroalkane groups, is in the form of a 15% strength aqueous dispersion and has a fluorine content of about 40% in the solid.

Component III: a mixture of 50% of a condensation product of 1 mol of hexamethylol-melamine pentamethyl ether, 1.5 mol of behenic acid and 0.9 mol of methyldiethanolamine at 130° C. for 3 hours and 50% of paraffin (melting point: 52° C.).

Commercially available synthetic resins and corresponding catalysts are also used for two-dimensional stabilization of the textile substrates of cotton and cotton/synthetic fibers and to influence the handle of the PAC awning fabrics.

(Synthetic resin·X: Fixapret CPN® (methylolation product of glyoxal monourein)

Synthetic resin Y: Acrafix MF® (Melamine/formaldehyde condensate)

Catalyst: Zinc nitrate

Phobizing liquors containing various amounts of the components, depending on the textile fiber substrate, are prepared from these components.

EXAMPLE 1

A woven cotton gabardine fabric having a weight per $m^2$ of about 240 g was finished with the following formulations:

| | (a) | (b) | (c) | |
|---|---|---|---|---|
| Synthetic resin X | 60 | 60 | 60 | g/l |
| Catalyst | 4 | 4 | 4 | g/l |
| Component II | 20 | 20 | 20 | g/l |
| Component I | — | 10 | — | g/l |
| Component III | — | — | 10 | g/l |

The cotton goods were impregnated with the liquors in a trough and squeezed off between two rubber rolls (mangle). The liquor pick-up was 70%, based on the weight of textile. The samples were dried at 100° C. and subjected to condensation at 150° C. for 5 minutes.

The finished goods were tested by the following method:

After climatization at 20° C.±2° C. and 65% relative atmospheric humidity for 24 hours, the finished textile samples were subjected to the corresponding tests:

1. The rain test is carried out in accordance with DIN 53 888 with the Dr. Bundesmann rain tester. Evaluation
   (a) Bead-off time in minutes
   (b) Bead-off effect in ratings 5-1
   Rating 5 denotes the highest lead-off effect
   Rating 1 denotes the lowest lead-off effect
   (c) Water absorption
   (d) Water strike-through in $cm^3$
2. The water-tightness test is carried out in accordance with DIN 53 886 (Schopper test).
3. The oil repellency test is carried out in accordance with AATCC test method 118-1978.

The rating for the oil repellency corresponds to the test liquid with the highest number which does not wet the fiber material within 30 seconds:
Rating 1 lowest value
Rating 8 highest value.

Testing gave the following values:

| | | (a) | (b) | (c) |
|---|---|---|---|---|
| 1a. | Bead-off time (minutes) | 0 | 10 | 10 |
| 1b. | Bead-off effect (rating 5-1) | 2 | 4 | 4 |
| 1c. | Water absorption (%) | 45 | 11 | 11 |
| 1d. | Water strike-through ($cm^3$) | 18 | 9 | 9 |
| 3. | Oil repellency (rating 8-1) | 1 | 4 | 3 |

The evaluation shows that the amount of fluorine component II employed is too low by itself for a water-repellent finish.

The addition of components I and III produces values which correspond to the standard of a rainwear finish in the water-repellency test 1*a–d*).

Component I claimed according to the invention already produces this increase when used in an amount of 1.5 g/l, based on the solid substance, whereas component III, which is not according to the invention, is effective only when an amount of 10 g/l is used.

EXAMPLE 2

The cotton samples finished under Example 1 were washed 5 times at 40° C. in a Miele washing machine model W 763 on the wash-and-wear programme using a customary household detergent and dried at 80° C. in a Miele domestic drier.

Testing produced the following values:

| | | (a) | (b) | (c) |
|---|---|---|---|---|
| 1a. | Bead-off time (minutes) | 0 | 10 | 4 |
| 1b. | Bead-off effect (rating 5-1) | 1 | 4 | 2 |
| 1c. | Water absorption (%) | 52 | 13 | 14 |
| 1d. | Water strike-through ($cm^3$) | 17 | 10 | 15 |
| 3. | Oil repellency (rating 8-1) | 0 | 3 | 1 |

Component I claimed according to the invention improves the washing resistance of fluorine finishes such that even after 5 machine washes the phobizing values are retained, whereas the finishes without extender or with component III decrease significantly.

EXAMPLE 3

Dyed polyester/cotton poplin goods (67% of PES/33% of cotton) with a weight per $m^2$ of about 160 g were finished on a mangle with the following formulations:

| | a. | b. |
|---|---|---|
| Synthetic resin X | 60 | 60 |
| Catalyst | 4 | 4 |
| Component II | 30 | 30 |
| Component I | — | 10 |

The liquor pick-up was 65% and the subsequent treatment was carried out as described in Example 1.

| | | (a) | (b) |
|---|---|---|---|
| 1a. | Bead-off time (minutes) | 3 | 10 |
| 1b. | Bead-off effect (rating 5-1) | 2 | 5 |
| 1c. | Water absorption (%) | 20 | 8 |
| 1d. | Water strike-through ($cm^3$) | 5 | 5 |
| 3. | Oil repellency (rating 8-1) | 2 | 4 |
| 2. | Schopper test (mm) | 225 | 330 |

Component I claimed according to the invention improves the wash resistance such that even after 5 machine washes, the phobizing values are retained almost completely.

EXAMPLE 4

A woven woolen fabric weighing 280 g/$m^2$ is finished on a pad-mangle as follows:

| | (a) | (b) | (c) | |
|---|---|---|---|---|
| Component II | 50 | 50 | 50 | g/l |
| Component I | — | 15 | — | g/l |
| Component III | — | — | 15 | g/l |

The liquor pick-up was 80%. After treatment at 100° C., the woven fabrics are treated at 140° C. for 3 minutes:

| | | (a) | (b) | (c) |
|---|---|---|---|---|
| 1a. | Bead-off time (minutes) | 0 | 10 | 3 |
| 1b. | Bead-off effect (rating 5-1) | 1 | 4 | 2 |
| 1c. | Water absorption (%) | 35 | 20 | 32 |
| 1d. | Water strike-through ($cm^3$) | 1 | 4 | 1 |

-continued

| | | (a) | (b) | (c) |
|---|---|---|---|---|
| 3. | Oil repellency (rating 8-1) | 5 | 6 | 4 |

Whilst no hydrophobicity values are achieved with fluorine component II, admixing component I claimed according to the invention achieved very good rain values. Only a slight improvement compared with the textile goods finished only with component II is achieved by component III.

It is claimed:

1. Hydrophobizing and eleophobizing compositions containing (A) a polymer containing perfluoroalkyl groups and (B) a cationically modified polyurethane which does not contain fluorine.

2. Compositions according to claim 1, characterized in that polymers containing a perfluoroalkyl group having 4 to 20 carbon atoms, which can be interrupted by oxygen, are employed as component (A).

3. Compositions according to claim 1 or 2, characterized in that component (A) is an acrylate polymer having a fluorine content of 20 to 45% by weight.

4. Compositions according to claim 1, characterized in that polyurethanes which have been built-up by also using compounds which contain a saturated or unsaturated hydrocarbon radical having 2 to 22 carbon atoms are employed as component (B).

5. Compositions according to claim 1 characterized in that component (B) contain build-up components containing acylurea groups of the formula $$-NH-CO-\underset{|}{N}-CO-R$$

wherein R denotes a saturated or unsaturated aliphatic hydrocarbon radical having up to 35 carbon atoms, or an aromatic hydrocarbon radical having 6 to 10 carbon atoms or an araliphatic hydrocarbon radical having 7 to 10 carbon atoms.

6. Compositions according to claim 1, characterized in that the component (B) contain build-up components containing acylurea groups of the formula $$-NH-CO-\underset{|}{N}-CO-R$$

the amount of which is chosen so that the polyisocyanate addition product contains 0.1 to 20% by weight, based on the solids content, of the structural unit of the formula $$-NH-CO-\underset{|}{N}-CO-R$$

which forms the acylurea groups mentioned and wherein R has the abovementioned meaning.

7. Compositions according to claim 1, characterized in that the polyurethane component (B) is used in the form of aqueous solutions or dispersions.

8. In the finishing of a textile wherein the textile is contacted with a polymer containing a perfluoroalkyl group, the improvement wherein the polymer is admixed with a cationically modified polyurethane which does not contain fluorine, thereby enhancing the effect of the polymer.

9. A textile structure finished with a composition according to claim 1.

10. A textile structure produced by the process of claim 8.

* * * * *

UNITED STATES PATENT AND TRADEMARK OFFICE

CERTIFICATE OF CORRECTION

PATENT NO. : 5,164,252

DATED : November 17, 1992

INVENTOR(S) : Henning, et al.

It is certified that error appears in the above-identified patent and that said Letters Patent is hereby corrected as shown below:

Col. 7, line 14 Delete " eleophobizing " and substitute -- oleophobizing --

Col. 7, line 23 Delete " or 2 "

Col. 8, line 20 Delete " -NH-CO-N-CO-R " and substitute -- -NH-CO-N-CO- --

Signed and Sealed this

Twenty-second Day of March, 1994

*Attest:*

BRUCE LEHMAN

*Attesting Officer*

*Commissioner of Patents and Trademarks*